US007445471B1

(12) United States Patent
Scherer et al.

(10) Patent No.: US 7,445,471 B1
(45) Date of Patent: Nov. 4, 2008

(54) ELECTRICAL CONNECTOR ASSEMBLY WITH CARRIER

(75) Inventors: Richard J. Scherer, Austin, TX (US); Adam P. Rumsey, Cedar Park, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/777,511

(22) Filed: Jul. 13, 2007

(51) Int. Cl.
*H01R 4/66* (2006.01)
*H01R 13/648* (2006.01)

(52) U.S. Cl. ..... 439/108; 439/701

(58) Field of Classification Search ..... 439/108, 439/608, 712, 495, 101
See application file for complete search history.

(56) References Cited

U.S. PATENT DOCUMENTS

| | | | | |
|---|---|---|---|---|
| 3,671,662 | A | 6/1972 | Miller et al. | |
| 3,757,029 | A | 9/1973 | Marshall | |
| 4,234,759 | A | 11/1980 | Harlow | |
| 4,406,512 | A | 9/1983 | Schell | |
| 4,655,518 | A | 4/1987 | Johnson et al. | |
| 4,680,423 | A | 7/1987 | Bennett et al. | |
| 4,816,618 | A | 3/1989 | Bongianni | |
| 4,976,628 | A * | 12/1990 | Fedder | 439/101 |
| 4,984,992 | A * | 1/1991 | Beamenderfer et al. | 439/108 |
| 5,015,197 | A * | 5/1991 | Redmond et al. | 439/329 |
| 5,116,230 | A | 5/1992 | Dechelette et al. | |
| 5,184,965 | A | 2/1993 | Myschik et al. | |
| 5,194,020 | A | 3/1993 | Voltz | |
| 5,197,893 | A * | 3/1993 | Morlion et al. | 439/101 |
| 5,245,134 | A | 9/1993 | Vana, Jr. et al. | |
| 5,421,735 | A * | 6/1995 | Dechelette | 439/101 |
| 5,455,383 | A | 10/1995 | Tanaka | |
| 5,554,038 | A * | 9/1996 | Morlion et al. | 439/108 |
| 5,631,446 | A | 5/1997 | Quan | |
| 5,711,676 | A | 1/1998 | Michael, III | |
| 6,005,193 | A | 12/1999 | Markel | |
| 6,010,788 | A | 1/2000 | Kebabjian et al. | |

(Continued)

FOREIGN PATENT DOCUMENTS

DE 41 16 166 C1 7/1992

(Continued)

OTHER PUBLICATIONS

U.S. Application entitled "Electrical Connector Assembly", filed Jan. 25, 2007, having U.S. Appl. No. 11/627,258.

(Continued)

*Primary Examiner*—Hae Moon Hyeon
(74) *Attorney, Agent, or Firm*—Johannes P. M. Kusters

(57) ABSTRACT

An electrical connector assembly includes a printed circuit board, a header, a carrier, and a plurality of electrical cable terminations retained by the carrier. The printed circuit board has a printed circuit board ground contact. The header is coupled to the printed circuit board and has a plurality of contact pins and, optionally, a plurality of ground elements. The carrier is configured to mate with the header. The header and electrical cable terminations are configured such that each of the plurality of electrical cable terminations makes electrical contact with one or more of the contact pins, ground elements, and printed circuit board ground contact when the header and carrier are in a mated configuration.

34 Claims, 13 Drawing Sheets

U.S. PATENT DOCUMENTS

| | | | |
|---|---|---|---|
| 6,086,383 | A | 7/2000 | Fasano et al. |
| 6,146,202 | A | 11/2000 | Ramey et al. |
| 6,148,130 | A | 11/2000 | Lee et al. |
| 6,183,301 | B1 | 2/2001 | Paagman |
| 6,231,391 | B1 | 5/2001 | Ramey et al. |
| 6,338,653 | B1 | 1/2002 | Jones et al. |
| 6,340,795 | B1 | 1/2002 | Caldwell |
| 6,368,120 | B1 | 4/2002 | Scherer et al. |
| 6,371,813 | B2 | 4/2002 | Ramey et al. |
| 6,501,350 | B2 | 12/2002 | Lester |
| 6,527,561 | B1 | 3/2003 | Glauser |
| 6,527,588 | B2 | 3/2003 | Paagman |
| 6,544,045 | B1 | 4/2003 | Paagman |
| 6,545,223 | B2 | 4/2003 | Baldock |
| 6,780,069 | B2 | 8/2004 | Scherer et al. |
| 6,849,799 | B2 | 2/2005 | Springer et al. |
| 7,004,793 | B2 | 2/2006 | Scherer et al. |
| 2002/0002013 | A1 | 1/2002 | Baldock |
| 2004/0110420 | A1 | 6/2004 | Wu |
| 2005/0077074 | A1 | 4/2005 | Tanaka |
| 2006/0254805 | A1 | 11/2006 | Scherer et al. |
| 2007/0141871 | A1 | 6/2007 | Scherer et al. |

FOREIGN PATENT DOCUMENTS

| | | |
|---|---|---|
| JP | HEI 06-181007 | 6/1994 |
| WO | WO 99 36998 A1 | 7/1999 |
| WO | WO 02 29938 A1 | 4/2002 |

OTHER PUBLICATIONS

U.S. Provisional Application entitled "Electrical Connector Assembly", filed Sep. 14, 2006, having U.S. Appl. No. 60/825,679.

U.S. Provisional Application entitled "Electrical Connector", filed Jan. 23, 2007, having U.S. Appl. No. 60/886,229.

* cited by examiner

ELECTRICAL CONNECTOR ASSEMBLY WITH CARRIER

TECHNICAL FIELD

The present invention relates generally to interconnections made between a printed circuit board and one or more electrical cables carrying signals to and from the printed circuit board.

BACKGROUND

The interconnection of printed circuit boards to other circuit boards, cables, or other electronic devices is well known in the art. Such interconnections typically have not been difficult to form, especially when the circuit switching speeds (also referred to as signal transition times) have been slow when compared to the length of time required for a signal to propagate through a conductor in the interconnect or on the printed circuit board. However, as circuit switching speeds continue to increase with modern integrated circuits and related computer technology, the design and fabrication of satisfactory interconnects has grown more difficult.

Specifically, there is a continued and growing need to design and fabricate printed circuit boards and their accompanying interconnects with closely controlled electrical characteristics to achieve satisfactory control over the integrity of the signal as it travels through the interconnect to and from the printed circuit board. The extent to which electrical characteristics (such as impedance) of the interconnect must be controlled depends heavily upon the switching speed of the circuit. That is, the faster the circuit switching speed, the greater the importance of providing an accurately controlled impedance within the interconnect.

Connector systems developed for high-speed board-to-board and board-to-cable interconnect applications are replete in the art. In general, an optimum printed circuit board interconnect design minimizes the length of marginally controlled signal line characteristic impedance by minimizing the physical spacing between the printed circuit board and the connector. Also, connector designs which involve relatively large pin and socket connectors with multiple pins devoted to power and ground contacts provide only marginally acceptable performance for high speed printed circuit boards.

Unfortunately, currently available high speed interconnect solutions for board-to-cable applications are typically complex, requiring extremely accurate component designs which are very sensitive to even small manufacturing variations and which, as a result, are expensive and difficult to manufacture. Even then, the performance of the available board-to-cable interconnect systems is becoming only marginally acceptable as switching speeds continue to increase. What is needed is a printed circuit board-to-cable interconnect system that provides the necessary impedance control for high speed integrated circuits while still being inexpensive and easy to manufacture.

SUMMARY

In one aspect, the present invention provides a carrier for use with an electrical connector assembly. The carrier includes an insulating housing having a front exterior wall on which a plurality of contact pin insertion apertures is disposed. The insulating housing further includes side exterior walls laterally extending from the front exterior wall. A plurality of first apertures is disposed on at least one of the side exterior walls. Each first aperture is configured to receive a first external electrical cable termination ground contact. The insulating housing further includes a plurality of interior walls laterally extending from the front exterior wall. Each of the plurality of interior walls includes a second aperture configured to receive a second external electrical cable termination ground contact. Optionally, the insulating housing may include a first housing part and a second housing part.

In another aspect, the present invention provides an electrical connector assembly including a printed circuit board having a printed circuit board ground contact, a header coupled to the printed circuit board and comprising a plurality of contact pins, a carrier, and a plurality of electrical cable terminations retained by the carrier. The carrier includes an insulating housing having a front exterior wall on which a plurality of contact pin insertion apertures is disposed. The insulating housing further includes side exterior walls laterally extending from the front exterior wall. A plurality of first apertures is disposed on at least one of the side exterior walls. Each first aperture is configured to receive a first external electrical cable termination ground contact. The insulating housing further includes a plurality of interior walls laterally extending from the front exterior wall. Each of the plurality of interior walls includes a second aperture configured to receive a second external electrical cable termination ground contact. The header and electrical cable terminations are configured such that each of the plurality of electrical cable terminations makes electrical contact with one or more of the contact pins and printed circuit board ground contact when the header and carrier are in a mated configuration.

In another aspect, the present invention provides an electrical connector assembly including a printed circuit board having a printed circuit board ground contact, a header coupled to the printed circuit board and comprising a plurality of contact pins and a plurality of ground elements, a carrier, and a plurality of electrical cable terminations retained by the carrier. The carrier includes an insulating housing having a front exterior wall on which a plurality of contact pin insertion apertures and a plurality of ground element insertion apertures are disposed. The insulating housing further includes side exterior walls laterally extending from the front exterior wall. A plurality of first apertures is disposed on at least one of the side exterior walls. Each first aperture is configured to receive a first external electrical cable termination ground contact. The insulating housing further includes a plurality of interior walls laterally extending from the front exterior wall. Each of the plurality of interior walls includes a second aperture configured to receive a second external electrical cable termination ground contact. The header and electrical cable terminations are configured such that each of the plurality of electrical cable terminations makes electrical contact with one or more of the contact pins, ground elements, and printed circuit board ground contact when the header and carrier are in a mated configuration.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims and their equivalents.

Figure 1:
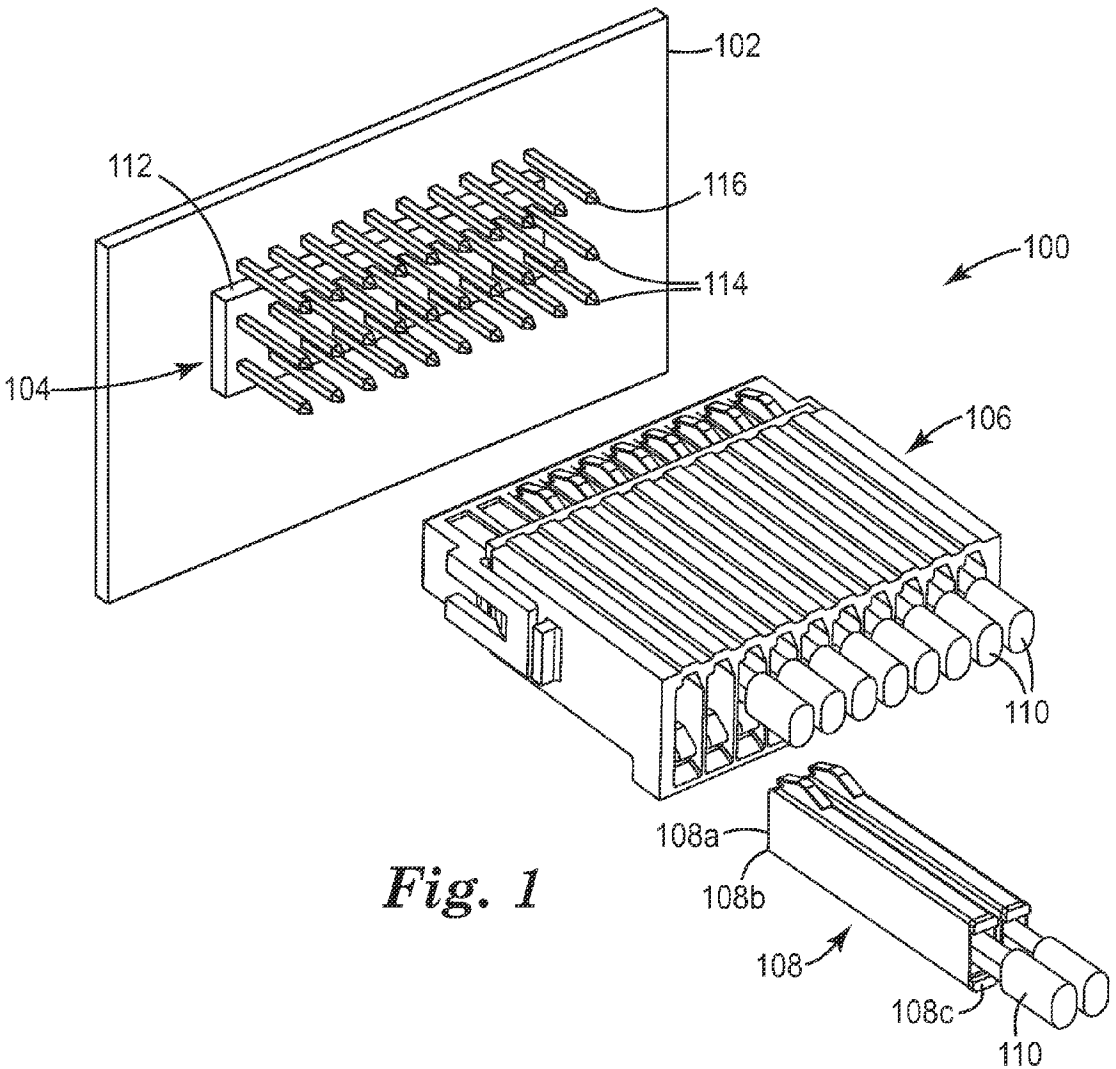
FIG. 1 is a perspective view of an exemplary embodiment of an electrical connector assembly according to an aspect of the present invention.
Figure 2:
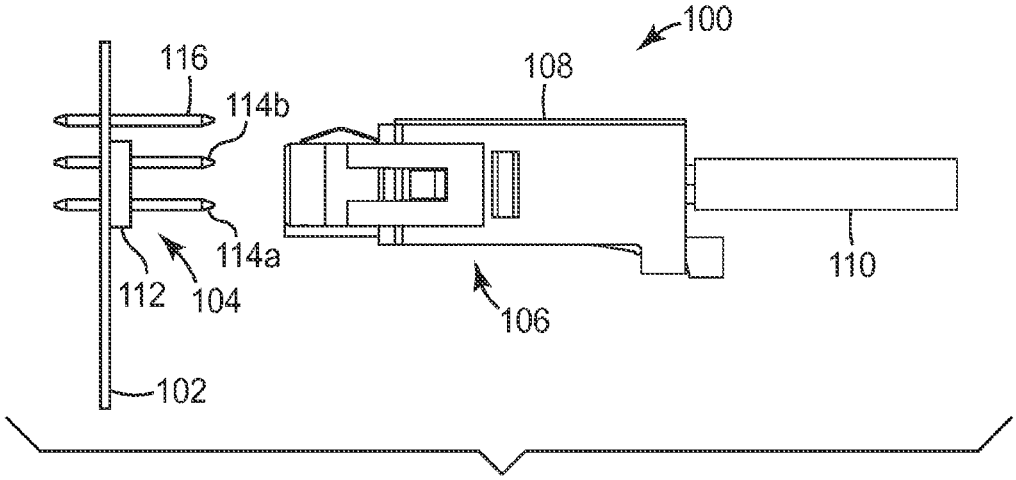
FIG. 2 is a side view of the electrical connector assembly of FIG. 1 showing the header and carrier of the electrical connector assembly in an unmated configuration.
Figure 3:
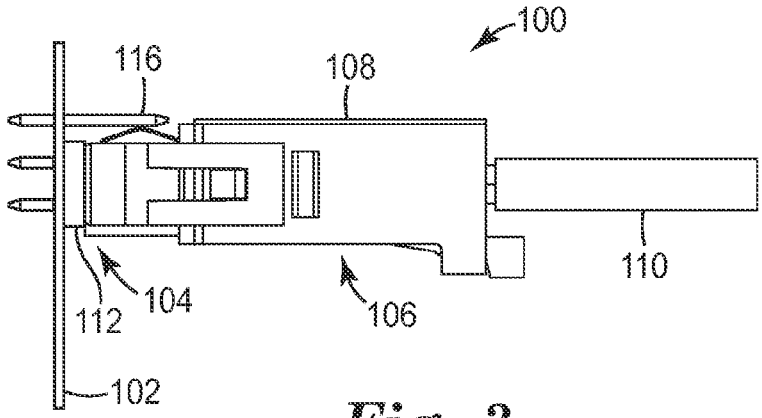
FIG. 3 is a side view of the electrical connector assembly of FIG. 1 showing the header and carrier of the electrical connector assembly in a mated configuration.

FIGS. 1-3 illustrate an exemplary embodiment of an electrical connector assembly according to an aspect of the present invention. Electrical connector assembly 100 includes a printed circuit board 102, a header 104 coupled to printed circuit board 102, and a carrier 106 retaining terminations 108 of individual electrical cables 110. Carrier 106 is configured to mate with header 104 to provide an interconnection between printed circuit board 102 and electrical cables 110.

For purpose of clarity, aspects of the invention are described and illustrated herein as used with twinaxial cables and twinaxial cable terminations. However, such illustration is exemplary only, and it is understood and intended that other types of electrical cables and their associated electrical cable terminations can be used, including but not limited to coaxial cables and other cable configurations with signal and ground elements. It is further understood and intended that different types and configurations of electrical cables and electrical cable terminations may be used simultaneously with electrical connector assemblies according to aspects of the present invention. For example, a portion of electrical cable terminations retained by a carrier may be twinaxial cable terminations, while another portion of electrical cable terminations retained by a carrier may be coaxial cable (or other) terminations.

Referring to FIG. 1, header 104 includes an insulative housing 112 containing a plurality of contact pins 114 arranged for mating with the internal contacts of electrical cable terminations 108 in carrier 106. Contact pins 114 of header 104 are connected to printed circuit board 102 as is known in the art. Contact pins 114 are configured for electrical connection to one or more of a plurality of electrical traces (not shown) of printed circuit board 102. Although header 104 is shown and described herein as a through-hole pin header, header 104 may also be a surface-mount pin header or any other suitable type of header known in the art. Contact pins 114 may be connected to printed circuit board 102 by soldering, press-fit, or any other suitable approach. In the embodiment of FIG. 1, header 104 is secured to printed circuit board 102 only by the connection between contact pins 114 and printed circuit board 102. Alternatively, header 104 may include additional structure(s) for securing header 104 to printed circuit board 102, such as mounting posts on insulative housing 112 configured for insertion into holes in printed circuit board 102 (not shown). The mounting posts may be retained in the holes in the printed circuit board 102 by press-fit, adhesive, or other suitable approach. In the embodiment of FIG. 1, header 104 is a straight or vertical pin header, whereby contact pins 114 have a substantially straight or vertical configuration, enabling an insertion of carrier 106 in a direction substantially perpendicular to printed circuit board 102. An exemplary header that can be used in an electrical connector assembly according to an aspect of the present invention is shown and described in U.S. Provisional Application No. 60/886,229, incorporated by reference herein in its entirety.

Printed circuit board 102 is substantially conventional in design except for the addition of a printed circuit board ground contact. In the exemplary embodiment of FIG. 1, the printed circuit board ground contact includes a plurality of ground pins 116. Each of the plurality of electrical cable terminations 108 is configured to make electrical contact with one of the plurality of ground pins 116 when header 104 and carrier 106 are in a mated configuration. Ground pins 116 are connected to printed circuit board 102 as is known in the art. Ground pins 116 are configured for electrical connection to one or more of a plurality of electrical traces (not shown) of printed circuit board 102. Although ground pins 116 are shown and described herein as through-hole pins, ground pins 116 may also be surface-mount pins or any other suitable type of contact pins known in the art. Contact pins 116 may be connected to printed circuit board 102 by soldering, press-fit, or any other suitable approach.

Header 104 and electrical cable terminations 108 may be configured such that each of the plurality of electrical cable terminations 108 makes electrical contact with one or more of contact pins 114 of header 104 and a printed circuit board ground contact when header 104 and carrier 106 are in a mated configuration. In the exemplary embodiment of FIGS. 1-3, as best seen in the side views of FIGS. 2 and 3, header 104 and electrical cable terminations 108 are configured such that each of the plurality of electrical cable terminations 108 makes electrical contact with two of the contact pins 114, illustrated in FIG. 2 as 114*a* and 114*b*, of header 104 and one of the ground pins 116 connected to printed circuit board 102, when header 104 and carrier 106 are in a mated configuration. In one aspect, a ground-signal-ground (GSG) configuration can be formed for improved impedance control through the interconnect by designating contact pin 114*a* as a ground contact, contact pin 114*b* as a signal contact, and ground pin 116 as a ground contact. It is understood and intended that any of contact pins 114 and ground pins 116 can be designated as signal, ground, or power contacts as is suitable for the intended application. Further, it is understood and intended that any of contact pins 114 and ground pins 116 can be eliminated from the array of pins as is suitable for the intended application.

Figure 4:
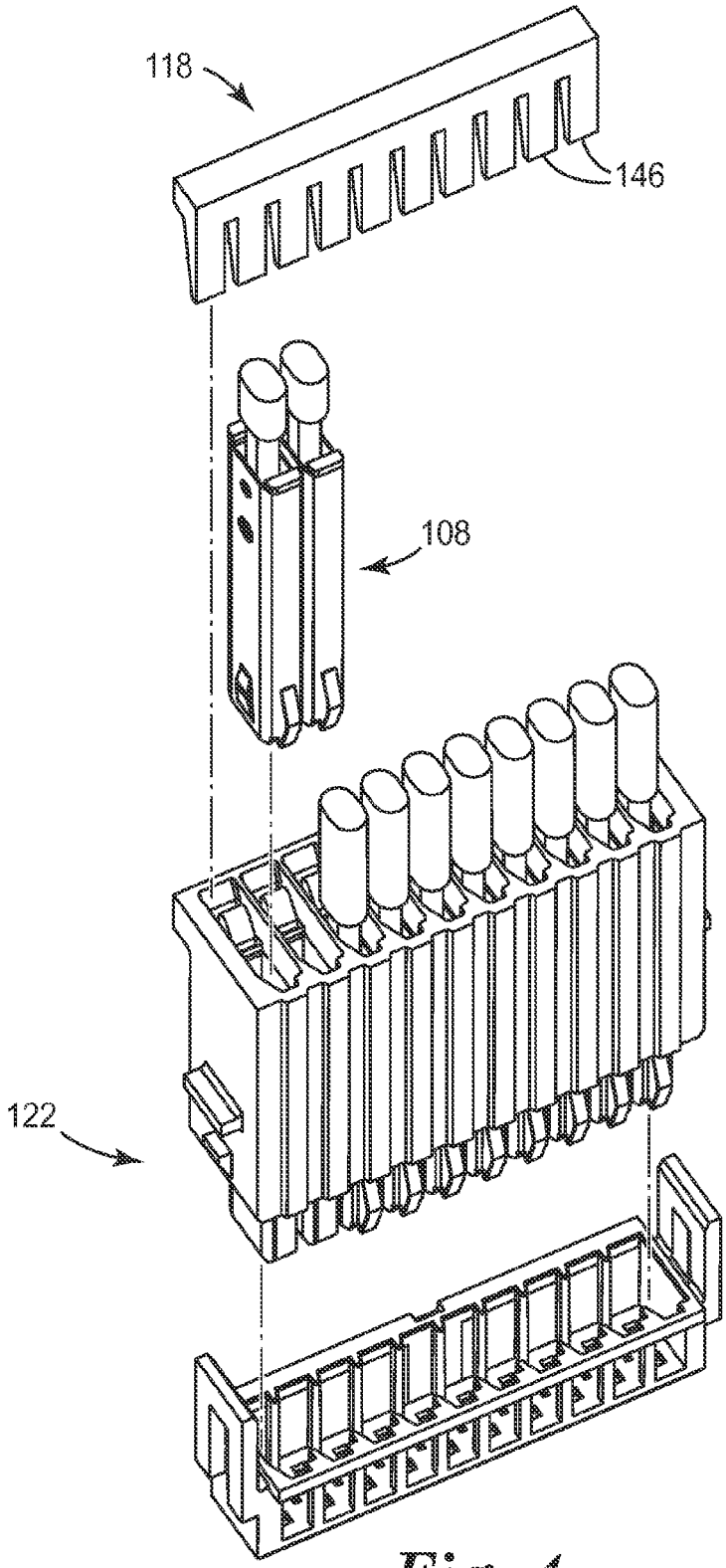
FIG. 4 is a perspective view of an exemplary embodiment of a carrier and a plurality of electrical cable terminations according to an aspect of the present invention.
Figure 5:
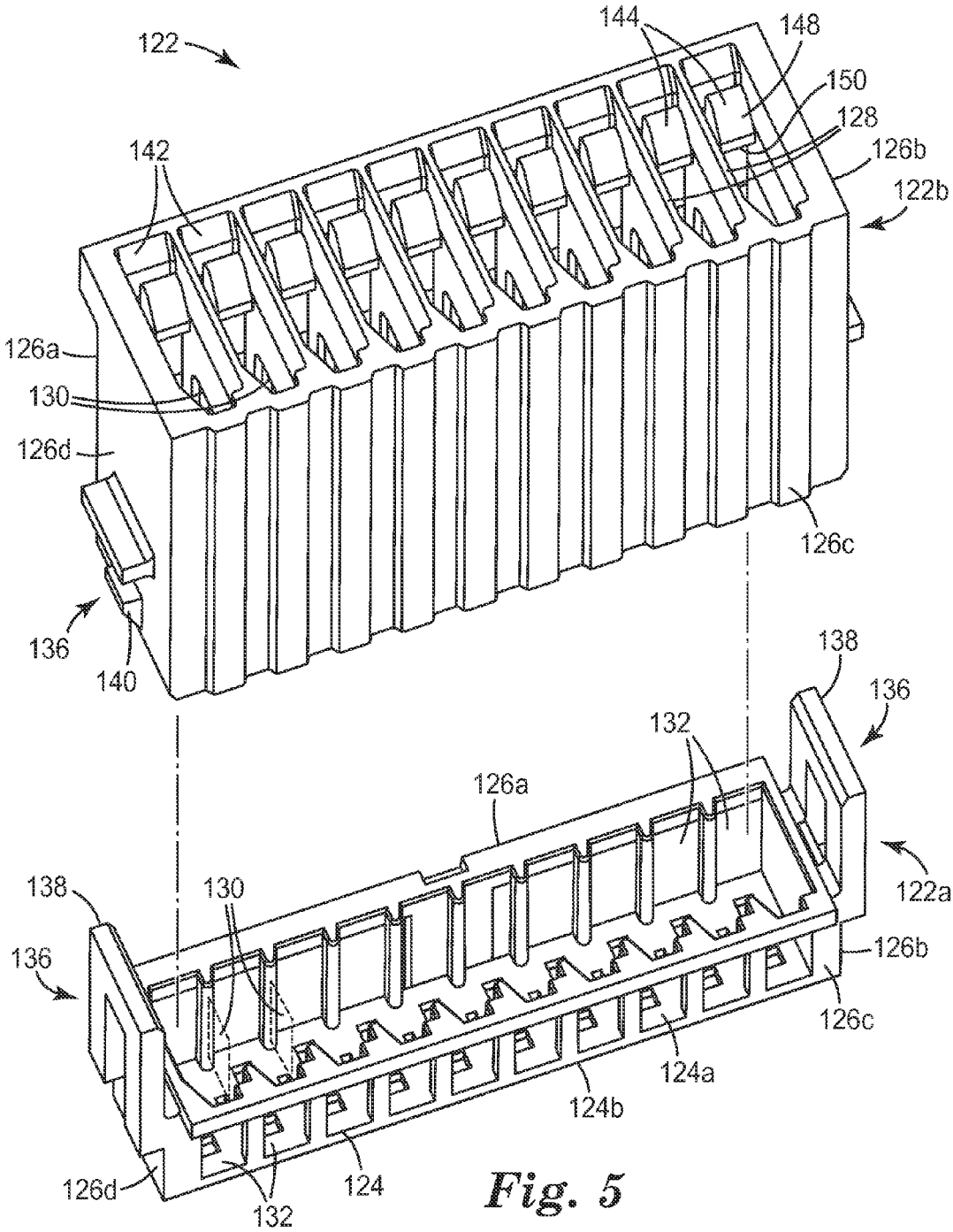
FIG. 5 is a top perspective view of an exemplary embodiment of a carrier according to an aspect of the present invention.
Figure 6:
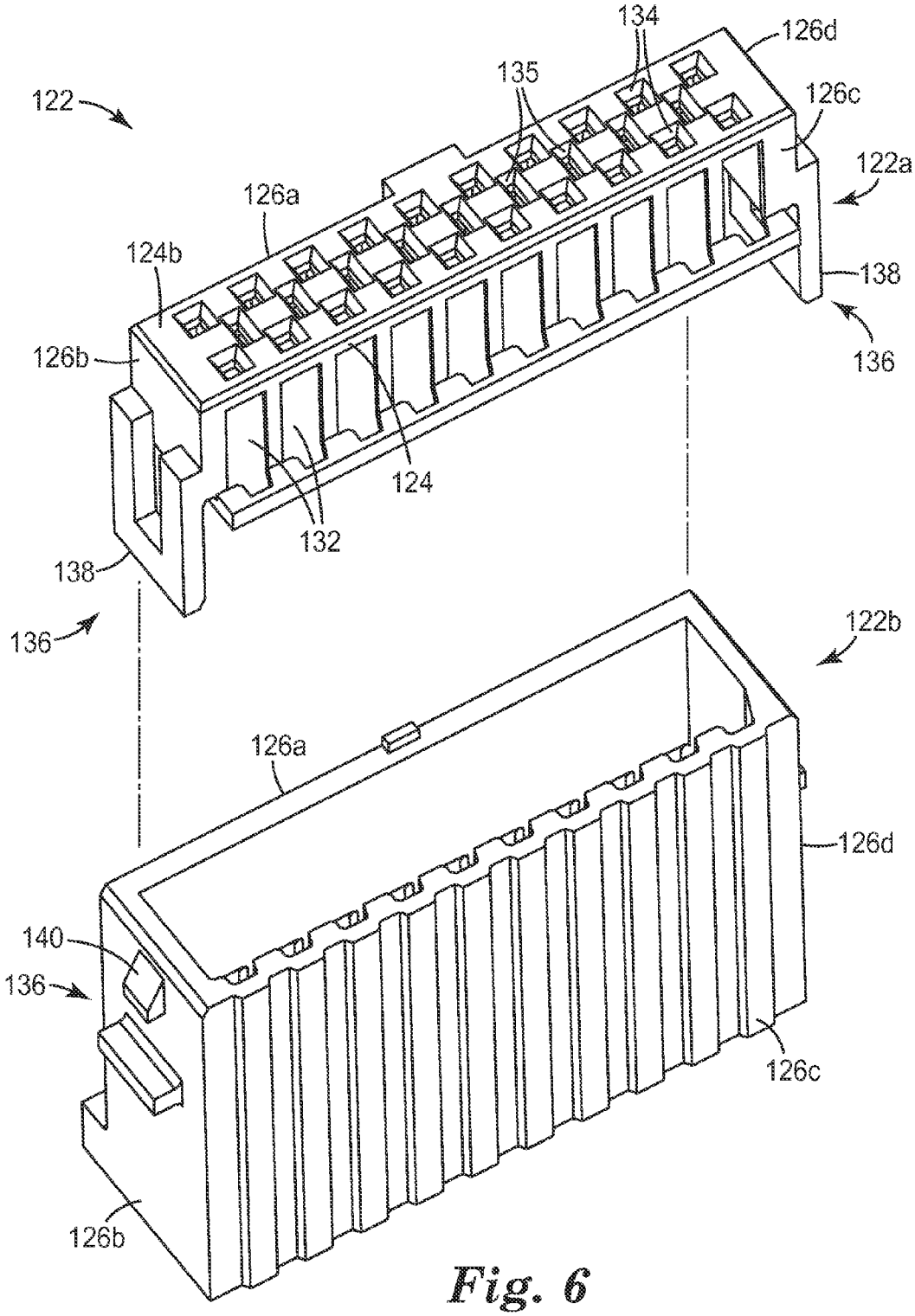
FIG. 6 is a bottom perspective view of the carrier of FIG. 5.

FIGS. 4-6 show different perspective views of a carrier according to an aspect of the present invention. As best seen in FIG. 4, carrier 106 of electrical connector assembly 100 is configured to retain a plurality of electrical cable terminations 108 and includes an insulating housing 122.

Referring to FIGS. 5 and 6, insulating housing 122 includes a first insulating housing part 122*a* and a second insulating housing part 122*b*. In an alternative aspect, insulating housing parts 122*a* and 122*b* may be formed as a single insulating housing 122. Insulating housing 122 has a front exterior wall 124, laterally extending side exterior walls 126*a*, 126*b*, 126*c*, and 126*d* (hereafter collectively referred to as 126, unless otherwise indicated), and a plurality of laterally extending interior walls 128, collaboratively defining a plurality of cavities 142 configured to receive and position individual electrical cable terminations 108.

Each electrical cable termination 108 is retained within its respective cavity 142 by a resilient latch 144 present in each cavity 142. As an electrical cable termination 108 is inserted into its respective cavity 142, a front edge 108*b* (as shown in FIG. 1) of electrical cable termination 108 engages a latch lead-in surface 148 and deflects latch 144 out of the path of electrical cable termination 108. As electrical cable termination 108 is fully inserted, latch 144 returns to its original (undeflected) position, and a latch hook member 150 engages a back edge 108*c* (as shown in FIG. 1) of electrical cable termination 108, thereby preventing electrical cable termination from being pulled out of carrier 106. Individual electrical cable terminations 108 can be removed from carrier 106 by simply deflecting latch 144 (as with a small tool or fingernail) to disengage latch hook member 150 from back edge 108*c* of electrical cable termination 108 while pulling gently on the associated electrical cable 110. The ability to remove and replace individual electrical cable terminations 108 is beneficial when replacing a damaged or defective electrical cable termination 108 of electrical cable 110, for example.

In one embodiment, carrier 106 further includes a wedge element 118 configured to secure the plurality of latch 144 and help retain the plurality of electrical cable terminations 108, as shown in FIG. 4. Wedge element 118 includes a plurality of wedges 146 configured to fit between latches 144 and side exterior wall 126*a* inside of cavities 142 of insulating housing 122. When properly installed, wedges 146 prevent latches 144 from deflecting out of the path of electrical cable terminations 108, thereby preventing electrical cable terminations 108 from being pulled out of carrier 106.

In other embodiments, electrical cable terminations 108 may be retained within carrier 106 by any suitable method/structure, including but not limited to snap fit, friction fit, press fit, mechanical clamping, and adhesive. Further, the method/structure used to retain electrical cable terminations 108 within carrier 106 may permit electrical cable terminations 108 to be removed individually, such as described above, the method/structure used to retain electrical cable terminations 108 within carrier 106 may permit electrical cable terminations 108 to be removed as a set, or the method/structure used to retain electrical cable terminations 108 within carrier 106 may permanently secure electrical cable terminations 108 within carrier 106. In other embodiments, cavities 142 of insulating housing 122 may be configured to receive more than one or all of the electrical cable terminations 108.

Each interior wall 128 of insulating housing 122 has an aperture 130 configured to receive a second external electrical cable termination ground contact 158, described in further detail below and illustrated in FIG. 7. Side exterior walls 126*a* and 126*c* include a plurality of apertures 132 that can be positioned in one or more of the side exterior walls 126. Each aperture 132 is configured to receive a first external electrical cable termination ground contact 156, described in further detail below and illustrated in FIG. 7. In one embodiment, apertures 132 can be positioned in side exterior walls 126*a* and 126*c* such that electrical cable terminations 108 can be positioned in insulating housing 122 either such that first external electrical cable termination ground contacts 156 are received in apertures 132 positioned in side exterior wall 126*a*, or such that first external electrical cable termination ground contacts 156 are received in apertures 132 positioned in side exterior wall 126*c*. In the illustrated embodiment of insulating housing 122, first and second insulating housing parts are designed such that second insulating housing part 122*b* can be assembled to first insulating housing part 122*a* either such that first external electrical cable termination ground contacts 156 of electrical cable terminations 108 are received in apertures 132 positioned in side exterior wall 126*a*, or such that first external electrical cable termination ground contacts 156 of electrical cable terminations 108 are received in apertures 132 positioned in side exterior wall 126*c*. This design enables electrical cables 110 to extend from electrical cable assembly 100 in two substantially different directions. Front exterior wall 124 has a plurality of contact pin insertion apertures 134 configured to receive contact pins 114 of header 104, illustrated in FIG. 1. As shown in FIG. 6, contact pin insertion apertures 134 preferably have a lead-in formed e.g. by chamfered edges to facilitate guidance and mating of contact pins 114 of header 104. Optionally, front exterior wall 124 has a plurality of ground element insertion apertures 135 configured to receive ground elements 760 of header 704, described in further detail below and illustrated in FIG. 16. Ground element insertion apertures 135 preferably have a lead-in formed e.g. by chamfered edges to facilitate guidance and mating of ground elements 760 of header 704. A significant advantage of an aspect of the present invention with respect to the prior art is that the various apertures described above enable arrangements of contact pins 114, ground contacts 156 and 158, and/or ground elements 760 that can provide an improved electrical performance of the electrical connector assembly.

In one embodiment, side exterior walls 126*b* and 126*d* of insulating housing 122 include cooperative latch elements 136 configured to retain first insulating housing part 122*a* and second insulating housing part 122*b* in an assembled configuration. In the embodiment illustrated in FIGS. 5 and 6, first insulating housing part 122*a* includes latch arms 138 that deflect to engage latch blocks 140 on second insulating housing part 122*b*. It is understood and intended that different and/or additional latch elements 136 may be provided as is suitable for the intended application.

Electrical cable terminations that can be used in conjunction with carrier 106 can be constructed substantially similar to the shielded controlled impedance (SCI) connectors for a coaxial cable described in U.S. Pat. No. 5,184,965, incorporated by reference herein. In particular, an exemplary embodiment of an electrical cable termination that can be used in conjunction with carrier 106 is shown in FIG. 7. Electrical cable termination 108 is coupled to electrical cable 110 through the use of solder opening 120. For use in conjunction with carrier 106, the electrical cable terminations are inserted into insulating housing 122 of carrier 106 (as best shown in FIG. 4) such that the front face 108*a* of electrical cable terminations 108 abuts interior surface 124*a* of front exterior wall 124 of insulating housing 122. Electrical cable termination 108 includes an electrically conductive housing 152 having mounted therein internal contacts 154. Each internal contact 154 can be designated as a signal/power contact, in which case it is electrically connected to a signal/power conductor of electrical cable 110 and electrically insulated from conductive housing 152. Each internal contact 154 can be designated as a ground contact, in which case it is electrically connected to a ground conductor (i.e. shield) of electrical cable 110 and/or to conductive housing 152. Internal contacts 152 are configured to make electrical contact with contact pins 114 of header 104. Internal contacts 152 lie along the longitudinal axis of electrical cable termination 108 and align with contact pin insertion apertures 134 of front exterior wall 124 of insulating housing 122.

Electrical cable termination 108 further includes a first external electrical cable termination ground contact 156. First external electrical cable termination ground contact 156 extends from an external surface of conductive housing 152 and is configured to make electrical contact with a ground contact of a printed circuit board. In the exemplary embodiment of an electrical connector assembly shown in FIG. 1, the printed circuit board ground contact includes a plurality of ground pins 116, whereby first external electrical cable termination ground contacts 156 are configured to make electrical contact with corresponding ground pins 116 when header 104 and carrier 106 are in a mated configuration. In other embodiments, the printed circuit board ground contact may include an electrically conductive strip or a plurality of ground pads, whereby first external electrical cable termination ground contacts 156 may be configured to make electrical contact with the electrically conductive strip or at least one of the plurality of ground pads when the header and carrier are in a mated configuration.

Electrical cable termination 108 further includes a second external electrical cable termination ground contact 158 extending from an external surface of conductive housing 152. In the exemplary embodiment of an electrical connector assembly shown in FIG. 1, second external cable termination ground contacts 158 (as shown in FIG. 7) are configured to make electrical contact with an adjacent electrical cable termination. In other embodiments, a mating header may include a plurality of ground elements, whereby second external electrical cable termination ground contacts 158 may be configured to make electrical contact with one or more of the ground elements when the header and carrier are in a mated configuration.

In the illustrated embodiments, both first external electrical cable termination ground contacts 156 and second external electrical cable termination ground contacts 158 include resilient beams extending from conductive housing 152. In other embodiments, first external electrical cable termination ground contacts 156 and/or second external electrical cable termination ground contacts 158 can take alternate forms from those illustrated, and may include, for example, a Hertzian bump extending from conductive housing 152.

Figure 8:
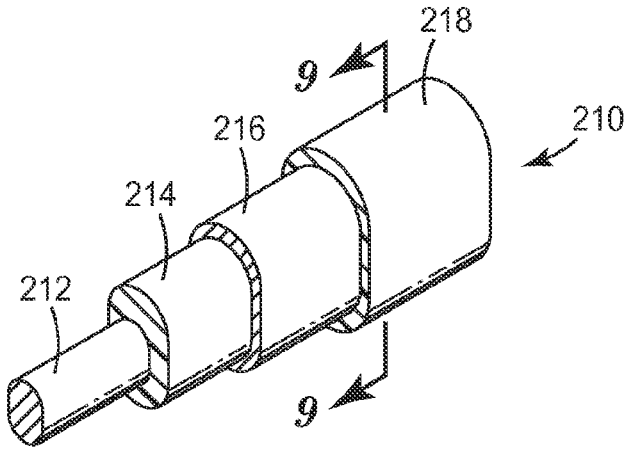
FIG. 8 is a partial sectional side perspective view of an electrical cable according to an aspect of the present invention.
Figure 9:
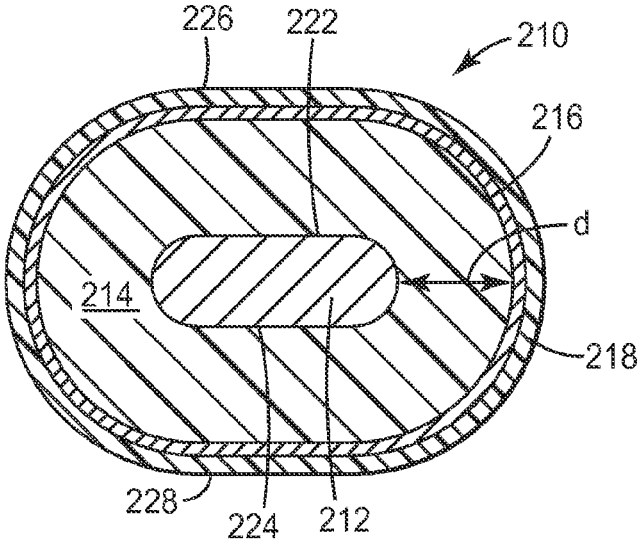
FIG. 9 is a cross-sectional view of the cable shown in FIG. 8, as taken along lines 9-9 in FIG. 8.

The type of electrical cable used in an aspect of the present invention can be a single wire cable (e.g. single coaxial or single twinaxial) or a multiple wire cable (e.g. multiple coaxial, multiple twinaxial, or twisted pair). FIG. 8 is a partial sectional side perspective view and FIG. 9 is a cross-sectional view of an exemplary embodiment of an electrical cable 210 according to an aspect of the present invention. Electrical cable 210 includes conductor 212, dielectric sheath 214, metallic shield 216, and jacket 218. Dielectric sheath 214 is formed around conductor 212 so as to generally surround conductor 212. Metallic shield 216 is formed around dielectric sheath 214 so as to generally surround dielectric sheath 214. Jacket 218 envelops metallic shield 216 to form an outer protective casing for electrical cable 210.

Conductor 212 may be made of a various conductive materials, including bare copper, tinned copper, silver plated copper, copper-covered steel, aluminum, or other suitable materials. Also, conductor 212 may be either a stranded or a solid element. In the case of a stranded element, conductor 212 is made of a plurality of electrically engaged conductive strands.

Electrical cable 210 is used in high frequency signal applications, such as those greater than 100 MHz. As described above, as signal frequency increases, the resistance of a conductor increases due to skin effect. Skin effect describes a condition where, due to magnetic fields produced by current flowing through the conductor, there is a concentration of current near the conductor surface. To maximize the surface area at the conductor surface, conductor 212 has a substantially oblong curvilinear cross-section. A substantially oblong curvilinear cross-section includes any elongated shape having rounded sides including, but not limited to, ovate, elliptical, capsule-shaped, and egg-shaped cross-sections. Because the substantially oblong curvilinear cross-section increases the surface area at the surface of conductor 212 over a conventional cylindrical conductor, the skin effect is minimized because more current flows along the larger surface. As a result, the signal attenuation characteristics of electrical cable 210 are improved since the overall resistance of conductor 212 is decreased.

In addition, in conventional approaches to improving the signal attenuation characteristics of electrical cables, larger cylindrical conductor diameters are used to compensate for the increase in resistance at higher frequencies. Larger inner conductor diameter sizes typically require larger volumes of dielectric surrounding the conductor to maintain desired cable impedance. This increases the overall size of the cable and prevents the cable from being used with standard micro-connectors used in high frequency systems. The substantially oblong curvilinear cross-section of conductor 212 allows electrical cable 210 to be used with existing cable connectors. In particular, conductor 212 permits a larger thousand circular mils (MCM) gauge equivalent conductor to fit into the height space restrictions of existing micro-connectors. The larger gauge conductor 212 also demonstrates better electrical performance (e.g., improved eye opening) due to improved rise time degradation characteristics.

Dielectric sheath 214 is formed around conductor 212 to provide insulation between conductor 212 and metallic shield 216. The thickness of dielectric sheath 214 is adjustable to control the impedance of electrical cable 210, since the thickness of dielectric sheath 214 controls the spacing between conductor 212 and metallic shield 216. In one embodiment, dielectric sheath 214 is extruded over conductor 212. In another embodiment, dielectric sheath 214 is a tape or wrap made of a dielectric material. Exemplary materials that may be used for dielectric sheath 214 include polyvinyl chloride (PVC), fluoropolymers including perfluoroalkoxy (PFA), fluorinated ethylene propylene (FEP), and foamed fluorinated ethylene propylene (FFEP), and polyolefins such as polyethylene (PE), foamed polyethylene (FPE), polypropylene (PP), and polymethyl pentane. In an alternative embodiment, dielectric sheath 214 may comprise a dielectric tube and a solid core filament spacer to define an air core surrounding conductor 212, such as that shown and described in U.S. Pat. No. 6,849,799, assigned to 3M Innovative Properties Company, St. Paul, Minn., which is herein incorporated by reference.

Metallic shield 216 is formed around dielectric sheath 214 to shield conductor 212 from producing external electromagnetic interference (EMI). Metallic shield 216 also helps to prevent signal interference from electromagnetic and electrostatic fields outside of electrical cable 210. Furthermore, metallic shield 216 provides a continuous ground for electrical cable 210. In one embodiment, the interior surface of metallic shield 216 is an equal distance d from conductor 212 around the entire periphery of conductor 212, as shown in FIG. 9. This results in even current distribution around the surface of conductor 212 (i.e., prevents current bunching), thus improving the signal attenuation characteristics of electrical cable 210. Metallic shield 216 may have a variety of configurations, including a metallic braid, a served shield, a metal foil, or combinations thereof.

Jacket 218 is formed around metallic shield 216 and provides a protective coating for electrical cable 210 and support for the components of electrical cable 210. Jacket 218 also insulates the components of electrical cable 210 from external surroundings. When jacket 218 is formed around metallic shield 216, outer surfaces 226 and 228 are substantially planar and parallel with surfaces 222 and 224 of conductor 212. Electrical cable 210 has a low profile in that the distance between surfaces 226 and 228 is less than the distance between the curved outer surfaces of electrical cable 210. This low profile allows electrical cable 210 to be used in applications having confined spaces or minimal amounts of extra space. Jacket 218 may be made of a flexible rubber material or a flexible plastic material, such as polyvinyl chloride (PVC), to permit installation of electrical cable 210 around obstructions and in tortuous passages. Other materials that may be used for jacket 218 include ethylene propylene diene (EPDM) elastomer, mica tape, neoprene, polyethylene, polypropylene, silicon, rubber, and fluoropolymer films available under the trade names TEFLON and TEFZEL from E.I. du Pont de Nemours and Company.

Figure 10:
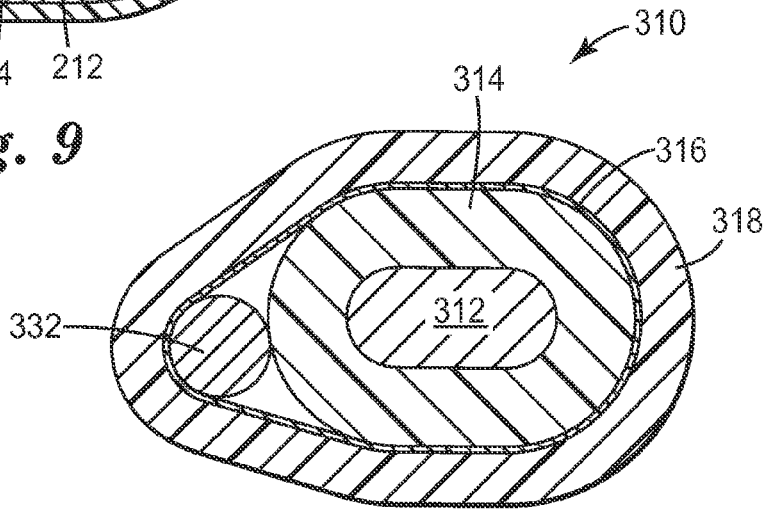
FIG. 10 is a cross-sectional view of another exemplary embodiment of an electrical cable according to an aspect of the present invention.

FIG. 10 is a cross-sectional view of an electrical cable 310 including a drain wire 332 according to another embodiment of the present invention. Electrical cable 310 includes conductor 312, dielectric sheath 314, metallic shield 316, and jacket 318, similar to conductor 212, dielectric sheath 214, metallic shield 216, and jacket 218 as shown and described with regard to electrical cable 210 in FIGS. 8 and 9. Drain wire 332 is positioned outside of dielectric sheath 314, and metallic shield 316 surrounds and is in contact with drain wire 332 and dielectric sheath 314. In an alternative embodiment, drain wire 332 may be placed outside of and in contact with metallic shield 316. Jacket 318 is formed around metallic shield 316 and provides a protective coating for electrical cable 310 and a support structure for the elements of electrical cable 310.

Drain wire 332 is in electrical contact with metallic shield 316. Drain wire 332 controls the impedance of electrical cable 310 by providing a method for electrical connection of metallic shield 316 to a connector. Drain wire 332 may be made of various conductive materials, including bare copper, tinned copper, silver plated copper, copper-covered steel, aluminum, or other suitable materials. Also, drain wire 332 may be either a stranded or a solid element. In the case of a stranded element, drain wire 332 is made of a plurality of electrically engaged conductive strands.

Figure 11:
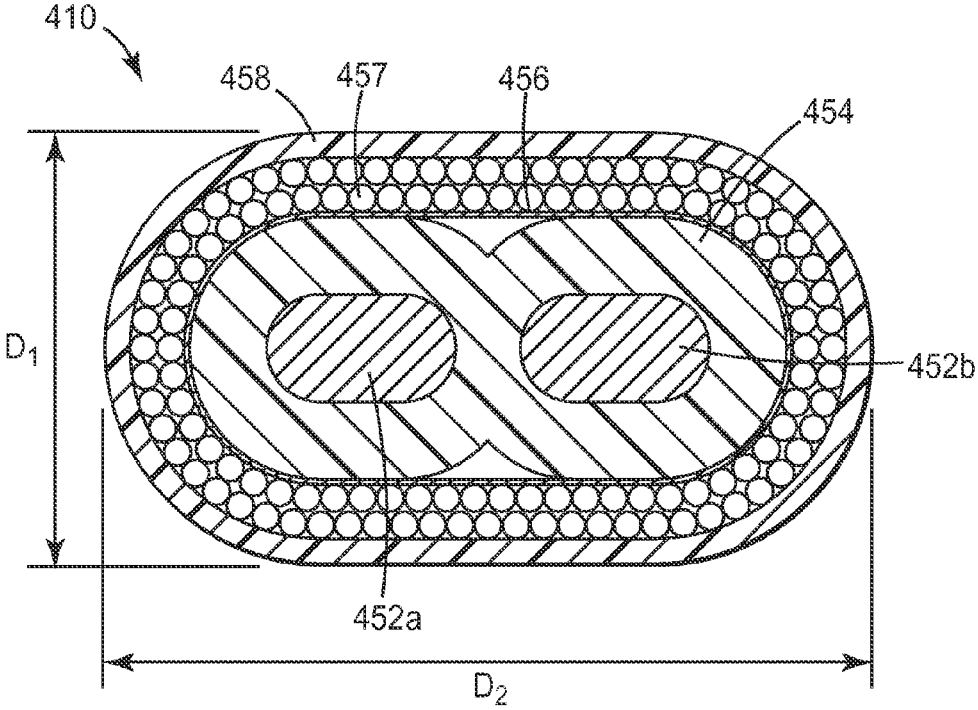
FIG. 11 is a cross-sectional view of another exemplary embodiment of an electrical cable according to an aspect of the present invention.

FIG. 11 is a cross-sectional view of an electrical cable 410 according to another embodiment of the present invention. Electrical cable 410 includes conductors 452*a* and 452*b*, unitary dielectric sheath 454, metal foil 456, metallic wire shield 457, and jacket 458. Dielectric sheath 454 is formed around conductors 452*a* and 452*b* so as to generally surround conductors 452*a* and 452*b*. Metal foil 456 is formed around dielectric sheath 454 so as to generally surround dielectric sheath 454, and metallic wire shield 457 surrounds metal foil 456. Jacket 458 envelops metallic wire shield 457 to form an outer protective casing for electrical cable 410.

Conductors 452*a* and 452*b* may be made of various conductive materials, including bare copper, tinned copper, silver plated copper, copper-covered steel, aluminum, or other suitable materials. Also, conductors 452*a* and 452*b* may be either a stranded or a solid element. In the case of a stranded element, each conductor is made of a plurality of electrically engaged conductive strands. In one embodiment, conductors 452*a* and 452*b* are positioned relative to each other such that major axes of the substantially oblong curvilinear cross-sections of conductors 452*a* and 452*b* are coplanar (as shown in FIG. 11).

Electrical cable 410 is used in high frequency signal applications, such as those greater than 100 MHz. As described above, to minimize the skin effect, it is desirable to maximize the surface area of each conductor at the conductor surface. To increase the surface area over conventional cylindrical conductors, conductors 452*a* and 452*b* each have a substantially oblong curvilinear cross-section. A substantially oblong curvilinear cross-section includes any elongated shape having rounded sides including, but not limited to, ovate, elliptical, capsule-shaped, and egg-shaped cross-sections. Because the substantially oblong curvilinear cross-section increases the surface area at the surface of conductors 452*a* and 452*b* over conventional cylindrical conductors, the skin effect is minimized since more current flows along the larger surface. As a result, the signal attenuation characteristics of electrical cable 410 is improved since the overall resistance of conductors 452*a* and 452*b* is decreased.

In addition, in conventional approaches to improving signal attenuation characteristics, larger cylindrical conductor diameters are used to compensate for the increase in resistance at higher frequencies. Larger conductor diameter sizes typically require larger volumes of dielectric surrounding the conductor to maintain desired cable impedance. This increases the overall size of the cable and prevents the cable from being used with standard micro-connectors used in high frequency systems. The substantially oblong curvilinear cross-sections of conductors 452*a* and 452*b* allow electrical cable 410 to be used with existing cable connectors. In particular, conductors 452*a* and 452*b* permit larger thousand circular mils (MCM) gauge equivalent conductors to fit into the height space restrictions of existing micro-connectors.

The larger gauge conductors 452*a* and 452*b* also demonstrate better electrical performance (e.g., improved eye opening) due to improved rise time degradation characteristics.

Dielectric sheath 454 is formed around conductors 452*a* and 452*b* to provide insulation between conductors 452*a* and 452*b* and metal foil 456. In one embodiment, dielectric sheath 454 is extruded over conductors 452*a* and 452*b*. The thickness of dielectric sheath 454 is adjustable to control the impedance of electrical cable 410, since the thickness of dielectric sheath 454 controls the spacing between conductors 452*a* and 452*b* and metal foil 456. The orientation of and spacing between conductors 452*a* and 452*b*, which can also have an effect on the impedance of electrical cable 410, may also be controlled by the extrusion of dielectric sheath 454 over conductors 452*a* and 452*b*. Exemplary materials that may be used for dielectric sheath 454 include polyvinyl chloride (PVC), fluoropolymers including perfluoroalkoxy (PFA), fluorinated ethylene propylene (FEP), and foamed fluorinated ethylene propylene (FFEP), and polyolefins such as polyethylene (PE), foamed polyethylene (FPE), polypropylene (PP), and polymethyl pentane. In an alternative embodiment, dielectric sheath 454 may comprise a dielectric tube and a solid core filament spacer to define an air core surrounding conductors 452*a* and 452*b*, such as that shown and described in U.S. Pat. No. 6,849,799.

Metal foil 456 and metallic wire shield 457 are formed around dielectric sheath 454 to shield conductors 452*a* and 452*b* from producing external EMI. Metal foil 456 and metallic wire shield 457 also help to prevent signal interference from electromagnetic and electrostatic fields outside of electrical cable 410. The combination of metal foil 456 and metallic wire shield 457 provides excellent shielding properties. Furthermore, metal foil 456 and metallic wire shield 457 provide a continuous ground for electrical cable 410. Metal foil 456 may be comprised of a material such as copper and copper alloys. Metallic wire shield 457 may be comprised of a braided copper or copper alloys.

Jacket 458 is formed around metallic wire shield 457 and provides a protective coating for electrical cable 410 and support for the components of electrical cable 410. Jacket 458 also insulates the components of electrical cable 410 from external surroundings. Electrical cable 410 has a low profile in that the distance $D_1$ between the planar surfaces of electrical cable 410 is less than the distance $D_2$ between the curved outer surfaces of electrical cable 410 (see FIG. 11). This low profile allows electrical cable 410 to be used in applications having confined spaces or minimal amounts of extra space. Jacket 458 may be made of a flexible rubber material or a flexible plastic material, such as polyvinyl chloride (PVC), to permit installation of electrical cable 410 around obstructions and in tortuous passages. Other materials that may be used for jacket 458 include ethylene propylene diene elastomer, mica tape, neoprene, polyethylene, polypropylene, silicon, rubber, and fluoropolymer films available under the trade names TEFLON and TEFZEL from E.I. du Pont de Nemours and Company.

Figure 12:
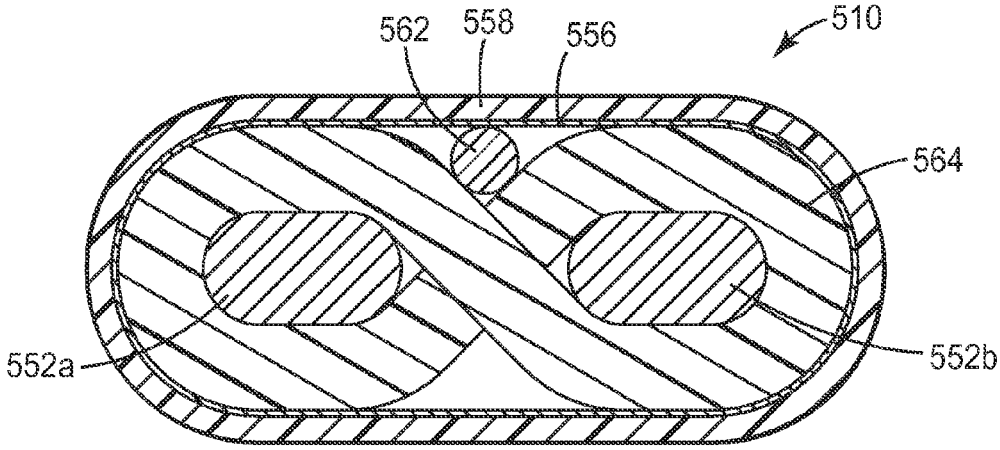
FIG. 12 is a cross-sectional view of another exemplary embodiment of an electrical cable according to an aspect of the present invention.

FIG. 12 is a cross-sectional view of electrical cable 510 according to another embodiment of the present invention including drain wire 562 and dielectric sheath 564 wrapped around conductors 552*a* and 552*b*. Electrical cable 510 includes metallic shield 556 and jacket 558, similar to metallic shield 456 and jacket 458 as shown and described with regard to electrical cable 410 in FIG. 11. Drain wire 562 is positioned outside of dielectric sheath 564 between dielectric sheath 564 and metallic shield 556. Metallic shield 556 surrounds and is in contact with drain wire 562 and dielectric sheath 64. In an alternative embodiment, drain wire 562 may be placed outside of and in contact with metallic shield 556. Jacket 558 is formed around metallic shield 556 and provides a protective coating for electrical cable 510 and a support structure for the elements of electrical cable 510.

Dielectric sheath 564 is taped or wrapped around conductors 552*a* and 552*b* to provide insulation between conductors 552*a* and 552*b* and metallic shield 556. Dielectric sheath 564 also controls the spacing between metal foil 556 and conductors 552*a* and 552*b*, the spacing between conductors 552*a* and 552*b*, and the orientation of conductors 552*a* and 552*b*. Because all of these parameters have an effect on the impedance of electrical cable 510, the impedance can be controlled by adjusting the thickness of dielectric sheath 564 and the orientation of conductors 552*a* and 552*b* held by dielectric sheath 564. Alternatively, dielectric sheath 564 may be extruded over conductors 552*a* and 552*b*, similar to dielectric sheath 454 in FIG. 11. Exemplary materials that may be used for dielectric sheath 564 include polyvinyl chloride (PVC), fluoropolymers including perfluoroalkoxy (PFA), fluorinated ethylene propylene (FEP), and foamed fluorinated ethylene propylene (FFEP), and polyolefins such as polyethylene (PE), foamed polyethylene (FPE), polypropylene (PP), and polymethyl pentane. In an alternative embodiment, dielectric sheath 564 may comprise a dielectric tube and a solid core filament spacer to define an air core surrounding conductors 552*a* and 552*b*, such as that shown and described in the previously incorporated U.S. Pat. No. 6,849,799.

Figure 13:
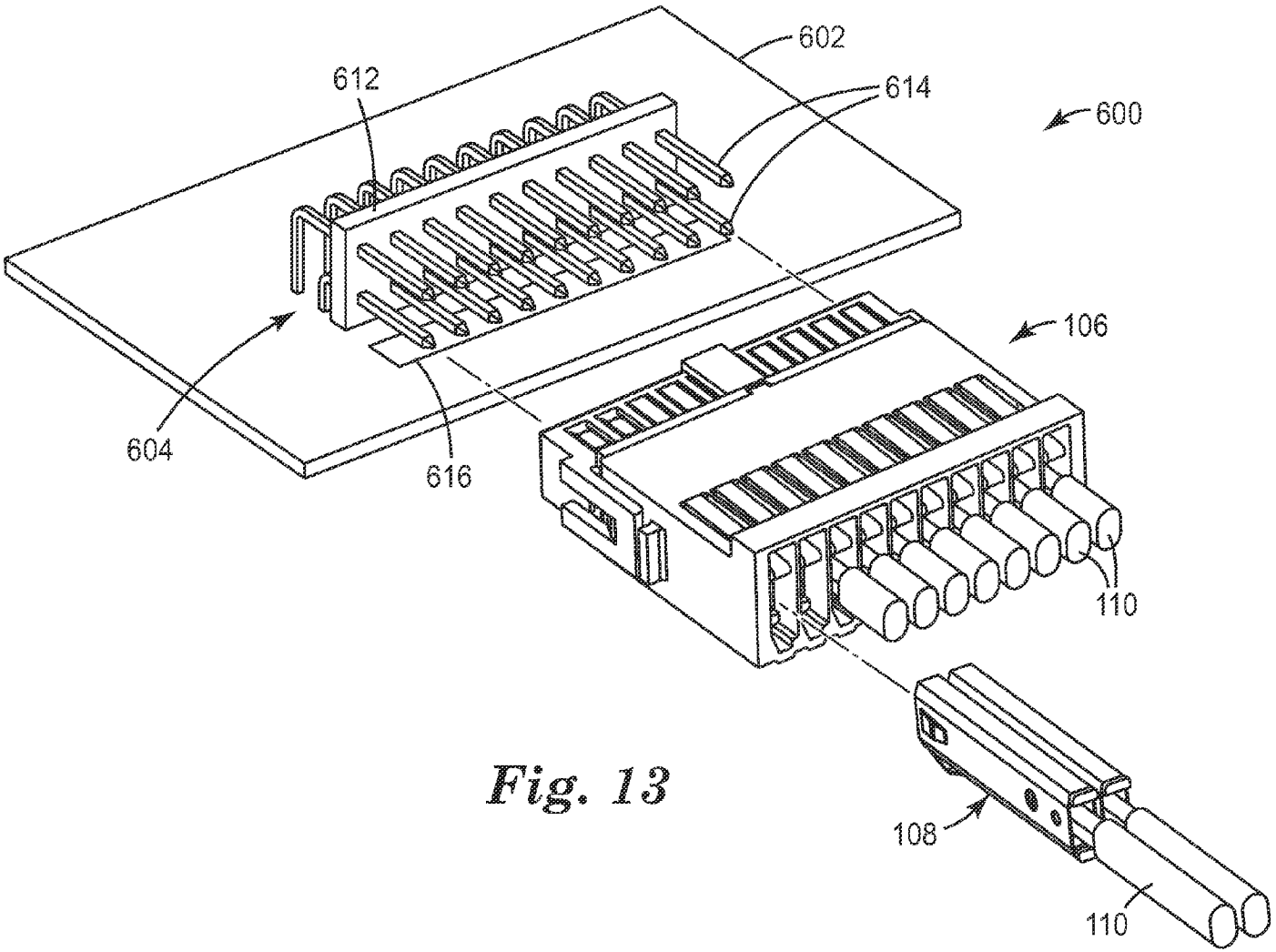
FIG. 13 is a perspective view of another exemplary embodiment of an electrical connector assembly according to an aspect of the present invention.
Figure 14:
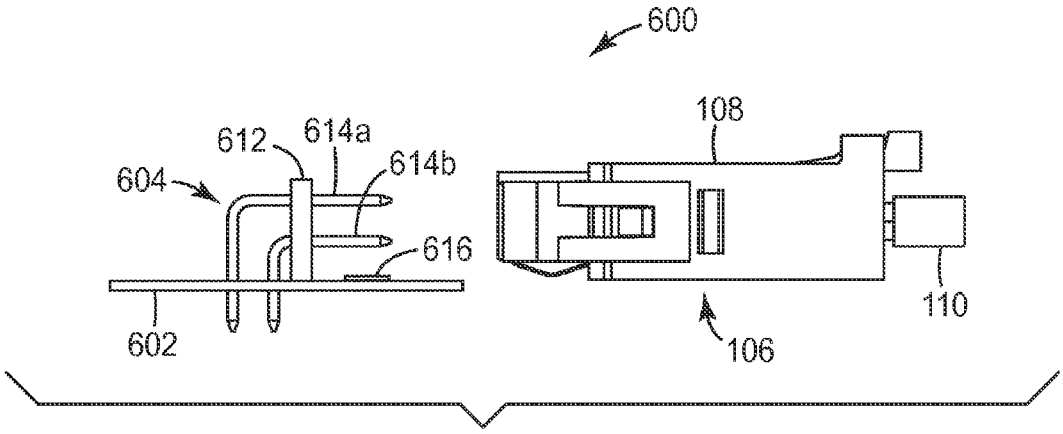
FIG. 14 is a side view of the electrical connector assembly of FIG. 13 showing the header and carrier of the electrical connector assembly in an unmated configuration.
Figure 15:
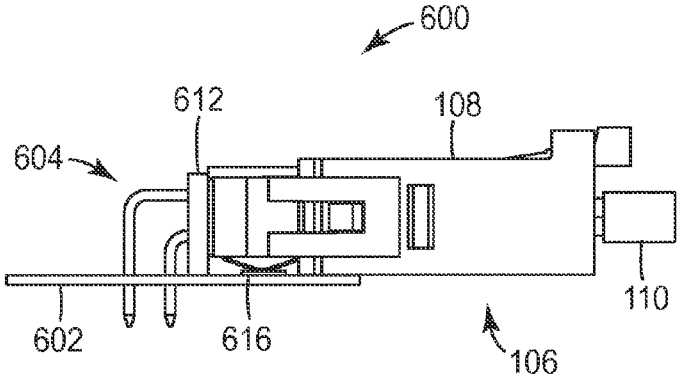
FIG. 15 is a side view of the electrical connector assembly of FIG. 13 showing the header and carrier of the electrical connector assembly in a mated configuration.

FIGS. 13-15 illustrate another exemplary embodiment of an electrical connector assembly according to an aspect of the present invention. Electrical connector assembly 600 includes a printed circuit board 602, a header 604 coupled to printed circuit board 602, and carrier 106 retaining terminations 108 of individual electrical cables 110. Carrier 106 is configured to mate with header 604 to provide an interconnection between printed circuit board 602 and electrical cables 110. Carrier 106, terminations 108, and electrical cables 110 were shown and described with regard to electrical connector assembly 100.

Referring to FIG. 13, header 604 includes an insulative housing 612 containing a plurality of contact pins 614 arranged for mating with the internal contacts of electrical cable terminations 108 in carrier 106. Contact pins 614 of header 604 are connected to printed circuit board 602 as is known in the art. Contact pins 614 are configured for electrical connection to one or more of a plurality of electrical traces (not shown) of printed circuit board 602. Although header 604 is shown and described herein as a through-hole pin header, header 604 may also be a surface-mount pin header or any other suitable type of header known in the art. Contact pins 614 may be connected to printed circuit board 602 by soldering, press-fit, or any other suitable approach. In the embodiment of FIG. 13, header 604 is secured to printed circuit board 602 only by the connection between contact pins 614 and printed circuit board 602. Alternatively, header 604 may include additional structure(s) for securing header 604 to printed circuit board 602, such as mounting posts on insulative housing 612 configured for insertion into holes in printed circuit board 602 (not shown). The mounting posts may be retained in the holes in the printed circuit board 602 by press-fit, adhesive, or other suitable approach. In the embodiment of FIG. 13, header 604 is a right angle pin header, whereby contact pins 614 have a substantially right angle configuration, enabling an insertion of carrier 106 in a direction substantially parallel to printed circuit board 602.

Printed circuit board 602 is substantially conventional in design except for the addition of a printed circuit board ground contact. In the exemplary embodiment of FIG. 13, the printed circuit board ground contact includes an electrically conductive strip 616. Each of the plurality of electrical cable terminations 108 is preferably configured to make electrical contact with electrically conductive strip 616 when header 604 and carrier 106 are in a mated configuration. Electrically conductive strip 616 is connected to printed circuit board 602 as is known in the art. For example, electrically conductive strip 616 may as be connected to printed circuit board 602 by soldering, press-fit, or any other suitable approach. Alternatively, electrically conductive strip 616 may be included in the printed circuit board artwork and thereby electrochemically deposited onto printed circuit board 602. In one embodiment, electrically conductive strip 616 extends continuously along the length of header 604, so that first external electrical cable termination ground contact 156 of each of the electrical cable terminations 108 a connected to a common ground. In another embodiment, electrically conductive strip 616 extends along less than all of the first external electrical cable termination ground contact 156. In yet another embodiment, electrically conductive strip 616 is separated into two or more separate segments, such that only selected ones of the first external electrical cable termination ground contacts 156 are connected to electrically conductive strip 616. In an alternative embodiment, the printed circuit board ground contact includes a plurality of ground pads. Each of the plurality of electrical cable terminations 108 is configured to make electrical contact with at least one of the plurality of ground pads when header 604 and carrier 106 are in a mated configuration. The ground pads are connected to printed circuit board 602 as is known in the art. For example, the ground pads may be included in the printed circuit board artwork and thereby electrochemically deposited onto printed circuit board 602.

Header 604 and electrical cable terminations 108 may be configured such that each of the plurality of electrical cable terminations 108 makes electrical contact with one or more of contact pins 614 of header 604 and a printed circuit board ground contact when header 604 and carrier 106 are in a mated configuration. In the exemplary embodiment of FIGS. 13-15, as best seen in the side views of FIGS. 14 and 15, header 604 and electrical cable terminations 108 are configured such that each of the plurality of electrical cable terminations 108 makes electrical contact with two of the contact pins 614, illustrated in FIG. 14 as 614*a* and 614*b*, of header 604 and electrically conductive strip 616 connected to printed circuit board 602, when header 604 and carrier 106 are in a mated configuration. In one aspect, a ground-signal-ground (GSG) configuration can be formed for improved impedance control through the interconnect by designating contact pin 614*a* as a ground contact, contact pin 614*b* as a signal contact, and electrically conductive strip 616 as a ground contact. It is understood and intended that any of contact pins 614 and electrically conductive strip 616 can be designated as signal, ground, or power contacts as is suitable for the intended application. Further, it is understood and intended that any of contact pins 614 can be eliminated from the array of pins and that portions of electrically conductive strip 616 can be eliminated as is suitable for the intended application.

Figure 7:
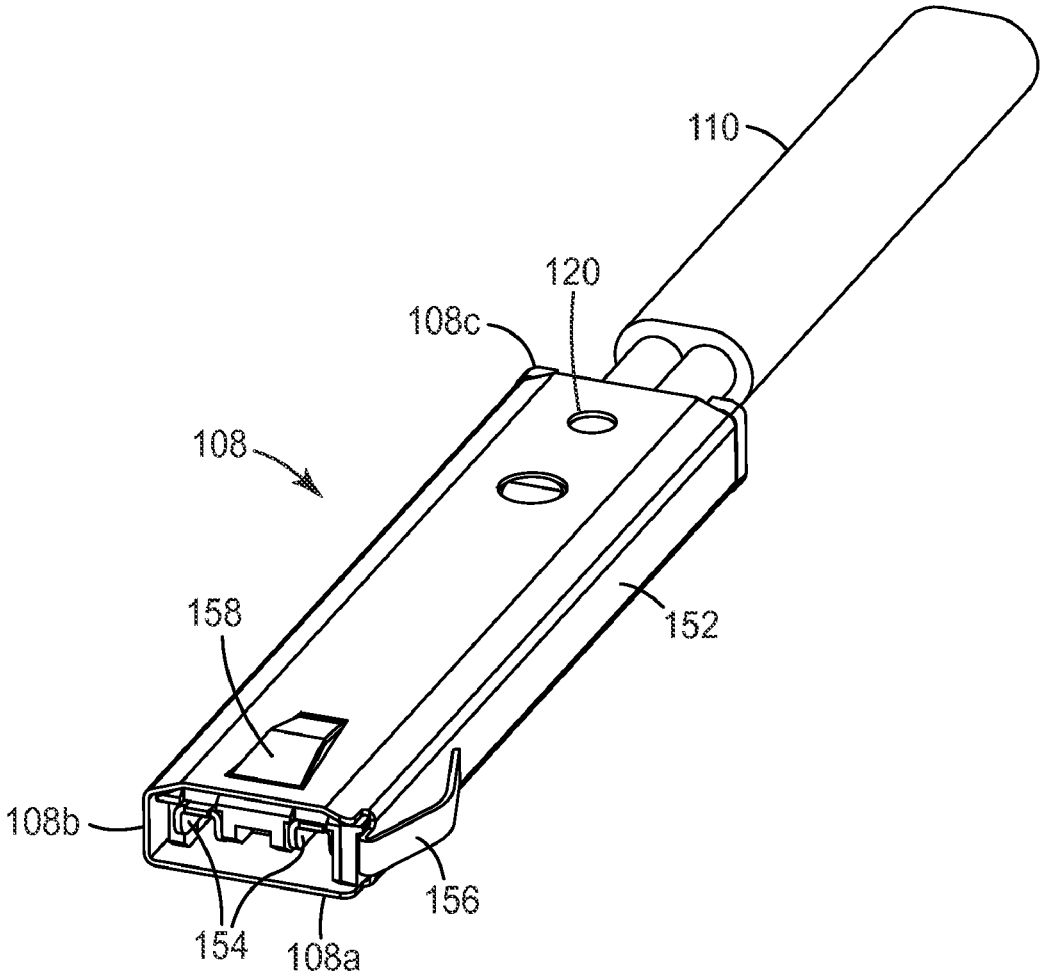
FIG. 7 is a perspective view of an exemplary embodiment of an electrical cable termination that can be used in the electrical connector assembly of FIG. 1.

In the exemplary embodiment of an electrical connector assembly shown in FIG. 13, first external electrical cable termination ground contacts 156 (as shown in FIG. 7) of electrical cable terminations 108 are configured to make electrical contact with electrically conductive strip 616 when header 604 and carrier 106 are in a mated configuration. Second external cable termination ground contacts 158 (as shown in FIG. 7) are configured to make electrical contact with an adjacent electrical cable termination.

Figure 16:
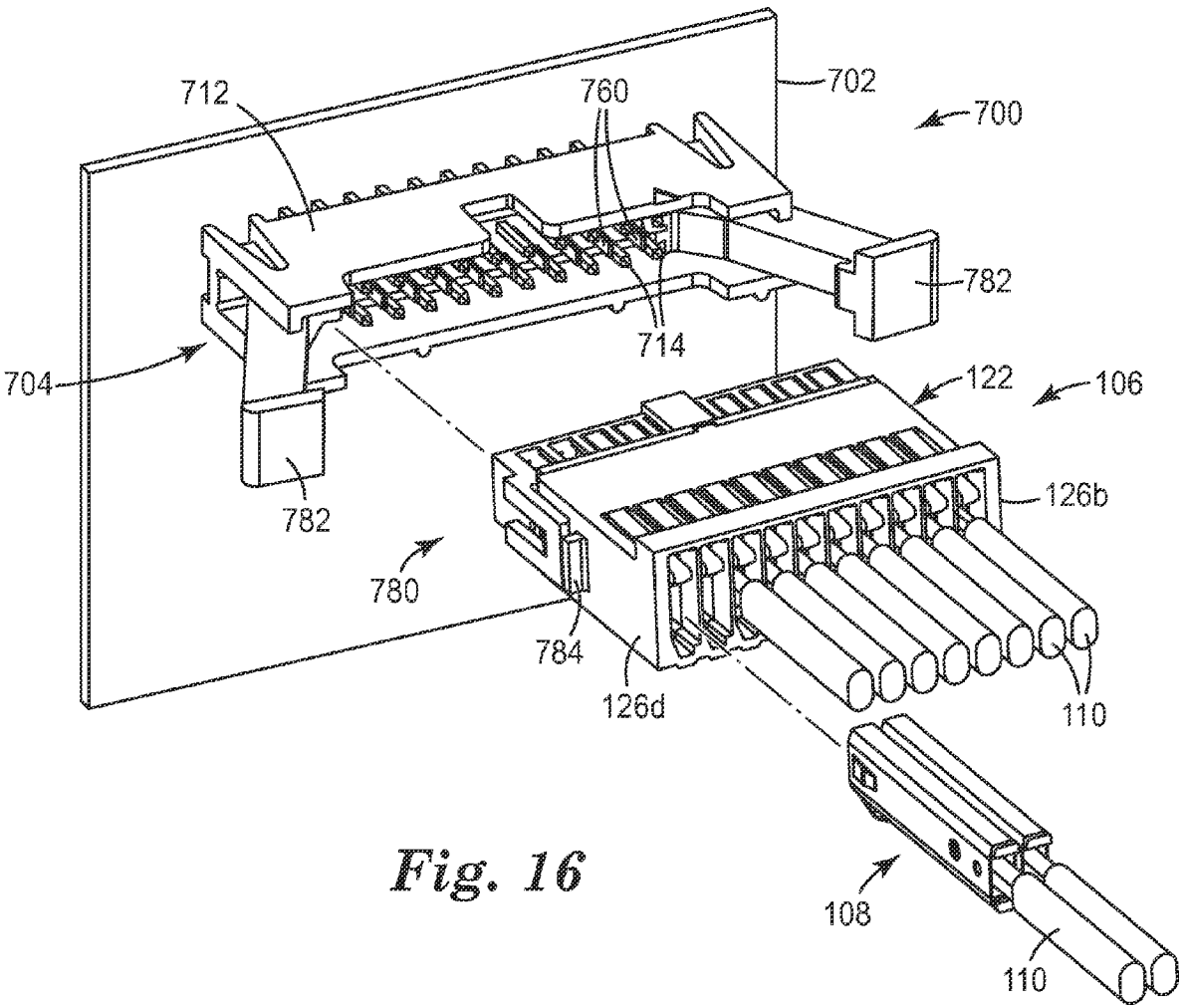
FIG. 16 is a perspective view of another exemplary embodiment of an electrical connector assembly according to an aspect of the present invention.
Figure 17:
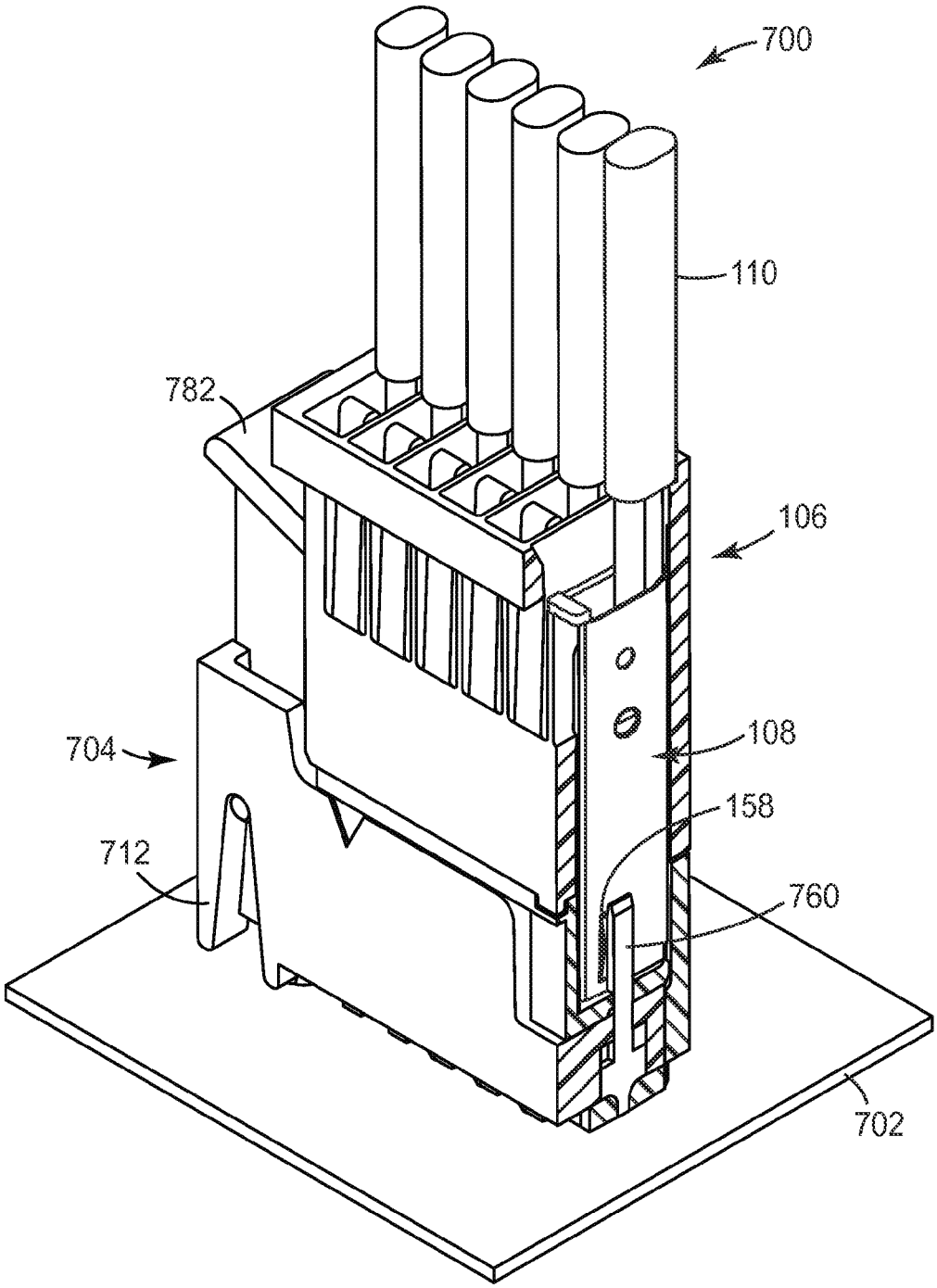
FIG. 17 is a perspective cross-sectional view of the electrical connector assembly of FIG. 16.
Figure 18:
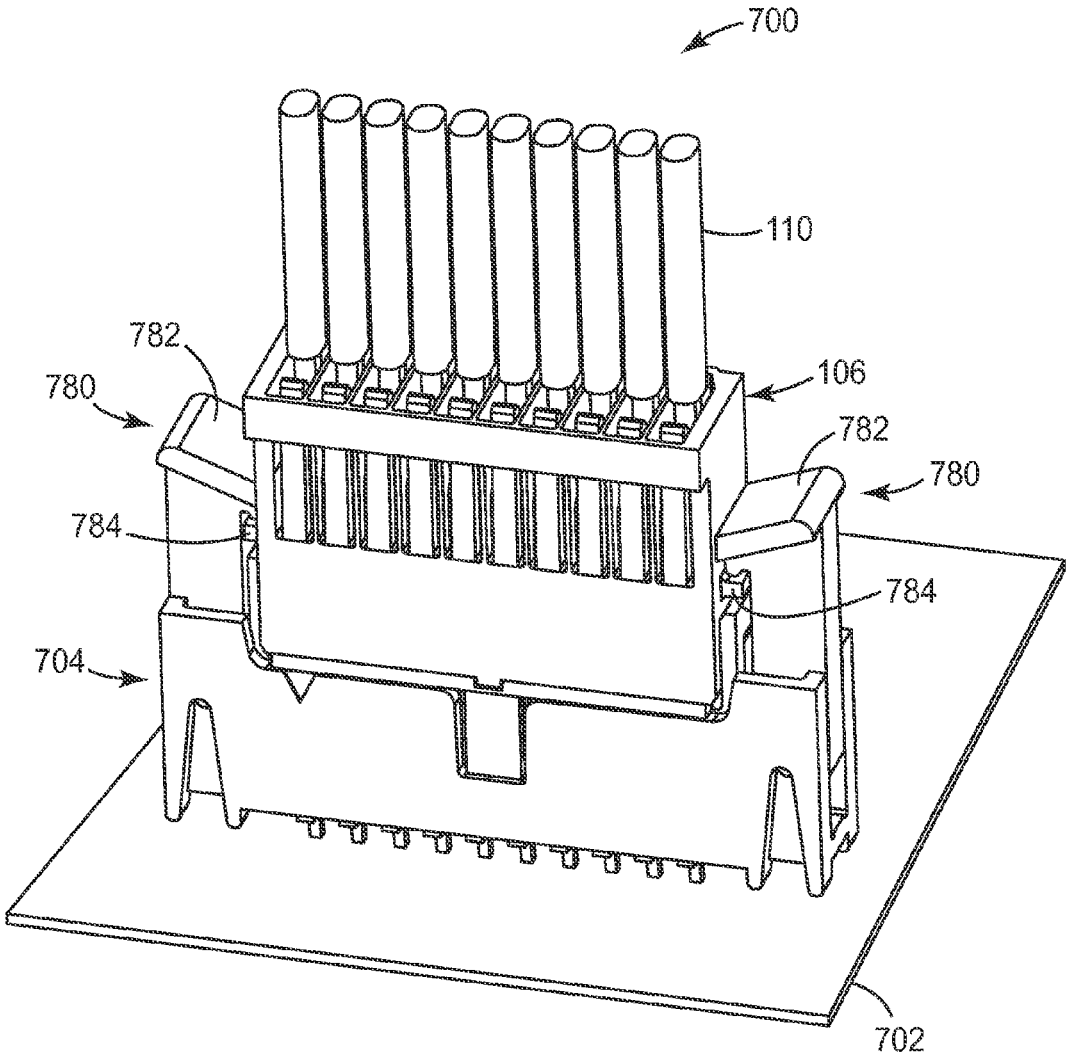
FIG. 18 is a perspective view of the electrical connector assembly of FIG. 16 showing the header and carrier of the electrical connector assembly in a mated configuration.

FIGS. 16-18 illustrate another exemplary embodiment of an electrical connector assembly according to an aspect of the present invention. Electrical connector assembly 700 includes a printed circuit board 702, a header 704 coupled to printed circuit board 702, and carrier 106 retaining terminations 108 of individual electrical cables 110. Carrier 106 is configured to mate with header 704 to provide an interconnection between printed circuit board 702 and electrical cables 110. Carrier 106, terminations 108, and electrical cables 110 were shown and described above with regard to electrical connector assembly 100.

In one embodiment, header 704 and carrier 106 include cooperative latch elements 780 configured to retain header 704 and carrier 106 in a mated configuration. In the embodiment of FIG. 16, header 704 includes latch arms 782 that rotate to engage latch block 784 on opposing side exterior walls 126*b* and 126*d* of insulating housing 122 of carrier 106. Latch arms 782 may be configured to automatically rotate into engagement with latch block 784 as carrier 106 is mated with header 704, or may alternatively be configured to require manual latching by the user. Different and/or additional latch elements 780 may be provided as is suitable for the intended application.

Referring to FIG. 16, header 704 includes an insulative housing 712 containing a plurality of contact pins 714 arranged for mating with the internal contacts of electrical cable terminations 108 in carrier 106. In addition, insulative housing 712 contains a plurality of ground elements 760 arranged for mating with the second external electrical cable termination ground contacts 158 of electrical cable termination 108 in carrier 106, as best shown in FIG. 17. Ground elements 760 may include ground blades, ground pins, and/or any other electrical contact types suitable to facilitate electrical grounding and/or electrical shielding functions. Contact pins 714 and ground elements 760 of header 704 are connected to printed circuit board 702 as is known in the art. Contact pins 714 and ground elements 760 are configured for electrical connection to one or more of a plurality of electrical traces (not shown) of printed circuit board 702. Although header 704 is shown and described herein as a through-hole pin header, header 704 may also be a surface-mount pin header or any other suitable type of header known in the art, including combinations of a through-hole pin header and a surface-mount pin header. For example, in one embodiment, header 704 is a surface-mount pin header, whereby contact pins 714 have a surface-mount configuration, but whereby ground elements 760 have a through-hole configuration. Contact pins 714 and ground elements 760 may be connected to printed circuit board 702 by soldering, press-fit, or any other suitable approach. In the embodiment of FIG. 16, header 704 is secured to printed circuit board 702 only by the connection between contact pins 714 and ground elements 760 and printed circuit board 702. Alternatively, header 704 may include additional structure(s) for securing header 704 to printed circuit board 702, such as mounting posts on insulative housing 712 configured for insertion into holes in printed circuit board 702 (not shown). The mounting posts may be retained in the holes in the printed circuit board 702 by press-fit, adhesive, or other suitable approach. In the embodiment of FIG. 16, header 704 is a straight or vertical pin header, whereby contact pins 714 and ground elements 760 have a substantially straight or vertical configuration, enabling an insertion of carrier 106 in a direction substantially perpendicular to printed circuit board 702.

Header 704 and electrical cable terminations 108 may be configured such that each of the plurality of electrical cable terminations 108 makes electrical contact with one or more of contact pins 714 of header 704, ground elements 760 of header 704, and a printed circuit board ground contact when header 704 and carrier 106 are in a mated configuration. In the exemplary embodiment of FIGS. 16-18, header 704 and electrical cable terminations 108 are configured such that each of the plurality of electrical cable terminations 108 makes electrical contact with two of the contact pins 714 of header 704, one of the ground elements 760 of header 704, and a printed circuit board ground contact (not shown) when header 704 and carrier 106 are in a mated configuration. It is understood and intended that any of contact pins 714, ground elements 760, and the printed circuit board ground contact can be designated as signal, ground, or power contacts as is suitable for the intended application. Further, it is understood and intended that any of contact pins 714 and/or ground elements 760 can be eliminated from the array of pins/elements as is suitable for the intended application.

In the exemplary embodiment of an electrical connector assembly shown in FIG. 16, first external electrical cable termination ground contacts 156 (as shown in FIG. 7) of electrical cable terminations 108 are configured to make electrical contact with a printed circuit board ground contact (not shown) when header 704 and carrier 106 are in a mated configuration. Second external cable termination ground contacts 158 (as shown in FIG. 7) are configured to make electrical contact with corresponding ground elements 760 when the header and carrier are in a mated configuration.

In each of the embodiments and implementations described herein, the various components of the electrical connector assembly and elements thereof are formed of any suitable material. The materials are selected depending upon the intended application and may include both polymers and metals. In one embodiment, insulating housing 122 of carrier 106 and insulative housing 112 of header 104 are formed of polymeric materials by methods such as injection molding, extrusion, casting, machining, and the like, while the electrically conductive components are formed of metal by methods such as molding, casting, stamping, machining the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A carrier for use with an electrical connector assembly and configured to retain a plurality of electrical cable terminations having a first external electrical cable termination ground contact and a second external electrical cable termination ground contact, the carrier comprising:

an insulating housing having a front exterior wall, and a plurality of contact pin insertion apertures disposed on the front exterior wall, laterally extending side exterior walls, and a plurality of first apertures disposed on at least one of the side exterior walls, each first aperture configured to receive the first external electrical cable termination ground contact, and a plurality of laterally extending interior walls each having a second aperture configured to receive the second external electrical cable termination ground contact.

2. The carrier of claim 1, wherein the insulating housing further comprises a plurality of latches configured to retain the plurality of electrical cable terminations.

3. The carrier of claim 2 further comprising a wedge element configured to secure the plurality of latches.

4. The carrier of claim 1, wherein the insulating housing further comprises a first housing part and a second housing part.

5. The carrier of claim 4, wherein the first housing part and second housing part further comprise cooperative latch elements configured to retain the first housing part and second housing part in an assembled configuration.

6. An electrical connector assembly comprising:

a printed circuit board having a printed circuit board ground contact;

a header coupled to the printed circuit board and comprising a plurality of contact pins;

a carrier configured to mate with the header and configured to retain a plurality of electrical cable terminations having a first external electrical cable termination ground contact and a second external electrical cable termination ground contact, the carrier comprising an insulating housing having a front exterior wall, and a plurality of contact pin insertion apertures disposed on the front exterior wall, laterally extending side exterior walls, and a plurality of first apertures disposed on at least one of the side exterior walls, each first aperture configured to receive the first external electrical cable termination ground contact, and a plurality of laterally extending interior walls each having a second aperture configured to receive the second external electrical cable termination ground contact; and the plurality of electrical cable terminations retained by the carrier, wherein the header and electrical cable terminations are configured such that each of the plurality of electrical cable terminations makes electrical contact with at least one of the contact pins and printed circuit board ground contact when the header and carrier are in a mated configuration.

7. The electrical connector assembly of claim 6, wherein the header and electrical cable terminations are configured such that each of the plurality of electrical cable terminations makes electrical contact with one of the plurality of contact pins and the printed circuit board ground contact when the header and carrier are in a mated configuration.

8. The electrical connector assembly of claim 6, wherein the printed circuit board ground contact comprises a plurality of ground pins, and wherein each of the plurality of electrical cable terminations is configured to make electrical contact with one of the plurality of ground pins when the header and carrier are in a mated configuration.

9. The electrical connector assembly of claim 6, wherein the printed circuit board ground contact comprises an electrically conductive strip, and wherein each of the plurality of electrical cable terminations is configured to make electrical contact with the electrically conductive strip when the header and carrier are in a mated configuration.

10. The electrical connector assembly of claim 6, wherein the printed circuit board ground contact comprises a plurality of ground pads, and wherein each of the plurality of electrical cable terminations is configured to make electrical contact with at least one of the plurality of ground pads when the header and carrier are in a mated configuration.

11. The electrical connector assembly of claim 6, wherein each of the plurality of electrical cable terminations comprises an internal contact within a housing, and the first external electrical cable termination ground contact on the outside of the housing, wherein the internal contact is configured to make electrical contact with one of the plurality of contact pins, and the first external electrical cable termination ground contact is configured to make electrical contact with the printed circuit board ground contact when the header and carrier are in a mated configuration.

12. The electrical connector assembly of claim 11, wherein each of the plurality of electrical cable terminations further comprises the second external electrical cable termination ground contact on the outside of the housing, wherein the second external electrical cable termination ground contact is configured to make electrical contact with an adjacent electrical cable termination.

13. The electrical connector assembly of claim 6, wherein the plurality of electrical cable terminations are retained by the carrier using one of a snap fit, friction fit, press fit, mechanical clamping, and adhesive.

14. The electrical connector assembly of claim 6, wherein the plurality of electrical cable terminations are individually removable from the carrier.

15. The electrical connector assembly of claim 6, wherein the plurality of electrical cable terminations are removable from the carrier as a set.

16. The electrical connector assembly of claim 6, wherein the plurality of electrical cable terminations are selected from the group consisting of coaxial cable terminations and twinaxial cable terminations.

17. The electrical connector assembly of claim 6, wherein each of the plurality of electrical cable terminations is coupled to an electrical cable comprising:

one or more inner conductors each having a substantially oblong curvilinear cross-section;

a dielectric material generally surrounding the one or more inner conductors;

a metallic outer shield generally surrounding the dielectric material; and an outer jacket enveloping the metallic outer shield.

18. The electrical connector assembly of claim 6, wherein the header comprises one of a surface mount pin header and a through-hole pin header.

19. The electrical connector assembly of claim 6, wherein the header comprises one of a straight pin header and a right angle pin header.

20. The electrical connector assembly of claim 6, wherein the header and carrier further comprise cooperative latch elements configured to retain the header and carrier in a mated configuration.

21. An electrical connector assembly comprising:

a printed circuit board having a printed circuit board ground contact;

a header coupled to the printed circuit board and comprising a plurality of contact pins and a plurality of ground elements;

a carrier configured to mate with the header and configured to retain a plurality of electrical cable terminations having a first external electrical cable termination ground contact and a second external electrical cable termination ground contact, the carrier comprising an insulating housing having a front exterior wall, and a plurality of contact pin insertion apertures and a plurality of ground element insertion apertures disposed on the front exterior wall, laterally extending side exterior walls, and a plurality of first apertures disposed on at least one of the side exterior walls, each first aperture configured to receive the first external electrical cable termination ground contact, and a plurality of laterally extending interior walls each having a second aperture configured to receive the second external electrical cable termination ground contact; and the plurality of electrical cable terminations retained by the carrier, wherein the header and electrical cable terminations are configured such that each of the plurality of electrical cable terminations makes electrical contact with one or more of the contact pins, ground elements, and printed circuit board ground contact when the header and carrier are in a mated configuration.

22. The electrical connector assembly of claim 21, wherein the header and electrical cable terminations are configured such that each of the plurality of electrical cable terminations makes electrical contact with one of the plurality of contact pins, one of the plurality of ground elements, and the printed circuit board ground contact when the header and carrier are in a mated configuration.

23. The electrical connector assembly of claim 21, wherein the printed circuit board ground contact comprises a plurality of ground pins, and wherein each of the plurality of electrical cable terminations is configured to make electrical contact with one of the plurality of ground pins when the header and carrier are in a mated configuration.

24. The electrical connector assembly of claim 21, wherein the printed circuit board ground contact comprises an electrically conductive strip, and wherein each of the plurality of electrical cable terminations is configured to make electrical contact with the electrically conductive strip when the header and carrier are in a mated configuration.

25. The electrical connector assembly of claim 21, wherein the printed circuit board ground contact comprises a plurality of ground pads, and wherein each of the plurality of electrical cable terminations is configured to make electrical contact with at least one of the plurality of ground pads when the header and carrier are in a mated configuration.

26. The electrical connector assembly of claim 21, wherein each of the plurality of electrical cable terminations comprises an internal contact within a housing, the first external electrical cable termination ground contact on the outside of the housing, and the second external electrical cable termination ground contact on the outside of the housing, wherein the internal contact is configured to make electrical contact with one of the plurality of contact pins, the first external electrical cable termination ground contact is configured to make electrical contact with the printed circuit board ground contact, and the second external electrical cable termination ground contact is configured to make electrical contact with one of the plurality of ground elements when the header and carrier are in a mated configuration.

27. The electrical connector assembly of claim 21, wherein the plurality of electrical cable terminations are retained by the carrier using one of a snap fit, friction fit, press fit, mechanical clamping, and adhesive.

28. The electrical connector assembly of claim 21, wherein the plurality of electrical cable terminations are individually removable from the carrier.

29. The electrical connector assembly of claim 21, wherein the plurality of electrical cable terminations are removable from the carrier as a set.

30. The electrical connector assembly of claim 21, wherein the plurality of electrical cable terminations are selected from the group consisting of coaxial cable terminations and twinaxial cable terminations.

31. The electrical connector assembly of claim 21, wherein each of the plurality of electrical cable terminations is coupled to an electrical cable comprising:

one or more inner conductors each having a substantially oblong curvilinear cross-section;

a dielectric material generally surrounding the one or more inner conductors;

a metallic outer shield generally surrounding the dielectric material; and an outer jacket enveloping the metallic outer shield.

32. The electrical connector assembly of claim 21, wherein the header comprises one of a surface mount pin header and a through-hole pin header.

33. The electrical connector assembly of claim 21, wherein the header comprises one of a straight pin header and a right angle pin header.

34. The electrical connector assembly of claim 21, wherein the header and carrier further comprise cooperative latch elements configured to retain the header and carrier in a mated configuration.

* * * * *